United States Patent [19]

Aber

[11] 4,018,407

[45] Apr. 19, 1977

[54] KITE

[75] Inventor: Arthur B. Aber, Montreal West, Canada

[73] Assignee: Stanbel, Incorporated

[22] Filed: Dec. 29, 1975

[21] Appl. No.: 644,962

[52] U.S. Cl. ..... 244/153 R

[51] Int. Cl.[2] ..... B64C 31/06

[58] Field of Search ..... 244/153 R, 154, 155 A

[56] References Cited

UNITED STATES PATENTS

| | | | |
|---|---|---|---|
| 2,785,870 | 3/1957 | Green | 244/153 R |
| 3,297,282 | 1/1967 | Cunningham | 244/153 R |
| 3,347,500 | 10/1967 | Hartig | 244/154 |

*Primary Examiner*—Trygve M. Blix
*Assistant Examiner*—Barry L. Kelmachter
*Attorney, Agent, or Firm*—Hill, Gross, Simpson, Van Santen, Steadman, Chiara & Simpson

[57] ABSTRACT

A kite has three hollow, tubular frame members joined together at the forward end of the kite by a nose piece having radial lugs receiving the frame tubes thereover. A flexible sheet such as plastic is affixed between a central tube and each of two side tubes to form a delta shaped lifting surface which may have dihedral between two halves thereof. A triangular keel surface is attached to the central tube and extends below the kite. Affixed to a lower-most portion of the keel is a string attachment plate for attachment of a string used to tether the kite during flight. The plate has three longitudinally-spaced attachment points or holes, each adapted to receive the string selectively depending upon wind strength conditions. Each attachment point or hole provides a different preferred angle of attack to the kite in various wind conditions and hence facilitates obtaining optimum performance from the kite.

3 Claims, 6 Drawing Figures

KITE

BACKGROUND OF THE INVENTION

Field of the Invention

The present invention relates to kites which are flown in the wind from a string held on the ground.

The Prior Art

Kite-flying has been a long-established sport and kites of many different configurations and structures are known. A current revival of interest in kite flying has resulted in simplications of kite design intended to afford sturdy yet light and well-flying kites. However, in simplifying the structures, the kites have become more sensitive to wind conditions, and it has been difficult to make a given kite fly well in a range of wind conditions. This is at least partly because kites heretofore have generally used only a single string attachment point on the kite, comprising a hole, a hook, or a knotted yoke to which the string is attached. A delta kite produced under U.S. Pat. No. 3,347,500 has two integral string attachment points fixed along a forward edge of the kite keel, for "normal" and "high" speed winds. Further, in the drive for simplicity in kite structure, kites have generally been permanently assembled with their lifting surfaces spread; they thus have been difficult to store and easily broken when not in use. Current kites commonly employ hollow square or rectangular plastic frame tubes assembled for use by placing their ends over lugs upon corner joining members. Such tubes are generally quite stiff and are not well suited to use in delta or keel kites requiring more flexible side frame members.

SUMMARY OF THE INVENTION

A kite suited for flying in any of various wind-strength conditions from a string comprises a plurality of frame members selectively arranged in and about a central plane of the kite. Lift surfaces are attached to and extend among the frame members. A strong attachment plate is affixed to the kit in its central plane, the plate having a plurality of discrete string attachment points spaced apart in the longitudinal direction of the kite. Placing the string in the forward-most of said points causes the kite to fly with a lower angle of attack to the wind than placing the string in one of the more rearward points. Thus, the forward attachment point is employed for use in higher winds than more rearward points, which are suited for lower-speed winds. The frame members of the kite comprise hollow tubular plastic members, removably joined to one another at the nose of the kite by attachment lugs formed on a nose piece of the kite. Removal of the side frame members from the lugs allows collapsing of the kite for storage. When the kite is a keel kite, the string attachment plate is affixed to a lower-most portion of the keel opposite and parallel to a central frame member.

DESCRIPTION OF THE PREFERRED EMBODIMENTS

Figure 1:
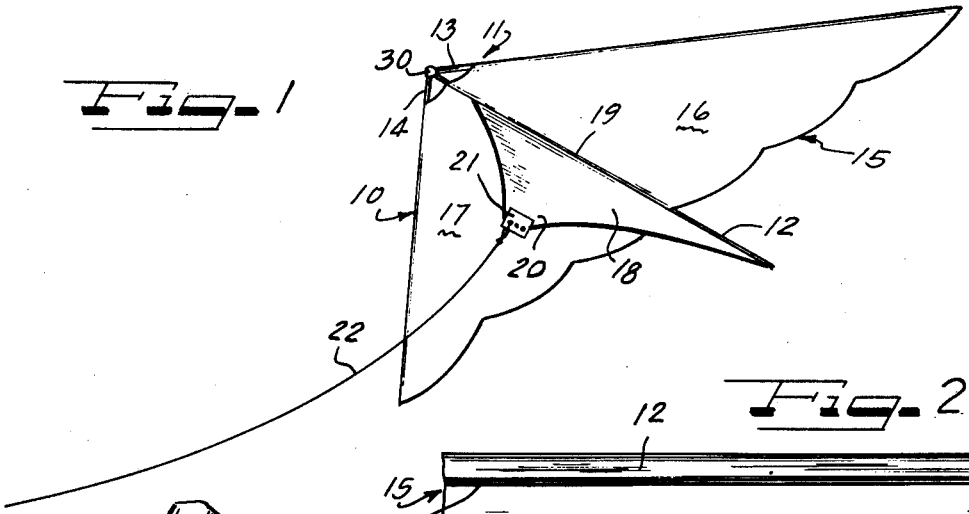
FIG. 1 is a perspective view from below of a kite of the present invention in flight in a wind.

A kite constructed in accordance with the principles of the present invention is shown in general perspective view at 10 in FIG. 1. The kite 10 comprises a frame 11 having three frame members 12, 13, and 14. These frame members 12—14 are hollow, generally cylindrical tubes constructed of a high impact plastic. Such plastic provides tubes which are relatively rigid but will bend substantially before deforming or breaking. The frame member 12 extends along a central axis of the kite 10 while the side frame members 13 and 14 extend respectively to the left and right sides of the kite at an angle from the central frame member 12, coplanar with one another.

Affixed among the frame members 12, 13, and 14 by adhesive means is a sheet-form material which provides a lifting surface 15 comprised of left and right delta wing portions 16 and 17, respectively. The lifting surface 15 is preferably a light, flexible plastic material which stretches under tension rather than tearing. It is not applied tautly among the frame members 11, but rather is free to form an air foil type surface and to roll or flap somewhat in the wind.

Extending downwardly from the lifting surface 15 and the central frame member 12, in a central, vertical, and longitudinal plane perpendicular to the plane of the frame members 11, is a keel surface 18 which is generally triangular in configuration and is made of a light plastic sheet. The keel 18 has an upper edge 19 and a lowermost portion 20 opposite thereto. A string attachment and reinforcing plate 21 is affixed to the portion 20 of the keel 18, for attachment of a string 22 by which the kite is controlled from the ground, as shown.

Figure 2:
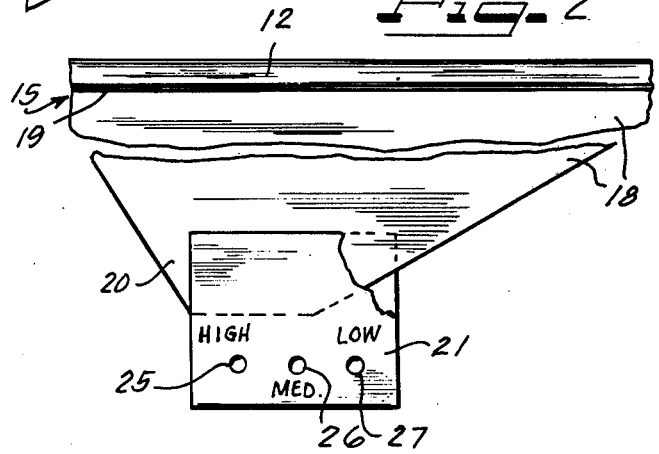
FIG. 2 is a detailed plan view, partially cut away, of a lower portion of the keel, showing the string attachment plate.

In accordance with the principles of the invention, and as shown in enlarged view in FIG. 2, the string attachment plate 21 forms a plurality of string attachment points 25, 26, 27. These points 25–27 are arranged substantially parallel to the upper edge 19 of the keel 18 and the central frame member 12, as shown in FIG. 2. Such plurality of discrete string attachment points 25–27 offers the flyer of the kite a chance to use his judgment in the placement of the string in the keel, providing not only a kite better adaptable to different wind conditions but also a feeling of being more in control of the kite. Engaging the string 22 in the forwardmost string attachment point 25 fixes the downward force of the string 22 at a position further forward than placing the string in either of the rearward attachment points 26 or 27 and causes the kite 10 to fly with a smaller angle of attack to the prevailing wind than if the string 22 were engaged in such rearward points 26 or 27. The smaller angle of attack reduces the forces on the kite by reducing the drag thereof in the wind and also reducing the lift of the kite against the string 22, so that the kite may be flown in higher wind conditions than otherwise possible. Placing the string 22 through the rearmost attachment point 27, conversely, increases the angle of attack of the kite 10 by moving the force from the string 22 to the rear. Such increased angle of attack increase the lift upon the lifting surfaces 15 in low wind speed conditions.

It has been found that spacing the forwardmost attachment point 25 about 2 inches (about 5 centimeters) from the rearmost point 27 gives a good range of string control for use in winds from the very lightest to those in which kites may normally not be flown for fear of loss or damage. It has also been found that use of three string attachment points 25, 26, and 27 as shown provides an adequate range of variation of the angle of attack of the kite 10, although finer adjustments may of course be obtained if more than three such points are provided in the string attachment plate 21. The attachment points 25–27 are shown as apertures, which are both light in weight and inexpensive to produce, but the points may be in the form of hooks or clamps without departing from the invention.

Figure 3:
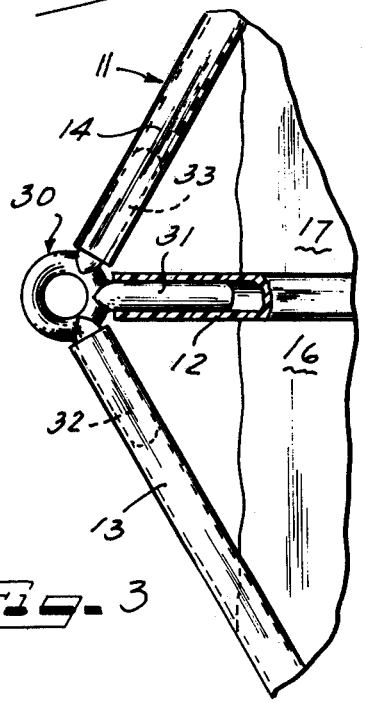
FIG. 3. is a top plan view, partially in section, of the nose of the kite of FIG. 1.

Also in accordance with the principles of the present invention, as depicted in FIG. 3, the frame members 11 are assembled to one another at the nose or apex of the kite 10 by means of a nose piece 30 having three radially outward extending lugs 31, 32, and 33. Each of the lugs 31–33 is sized to fit snugly within the corresponding one of the frame members 11. The lugs 32 and 33 in this embodiment are coplanar with one another and with the lug 31, and the angles formed by the pairs of lugs 31 and 32 and 31 and 33 are equal to provide a symmetrical kite and equal-size lifting surfaces 16 and 17. Generally the nose piece 30 will be left assembled upon the central frame member 12 via the lug 31, but the side frame members 13 and 14 are conveniently disengaged from the lugs 32 and 33 for storage of the kite 10 between flights. When assembled, the frame tubes 13 and 14 cannot readily be disengaged from the lugs 32 and 33 since the lifting surface 15 becomes taut between the central frame member 12 and either of the side frame members 13 and 14 as the latter move outwardly along their lugs 32 or 33. Thus, disengagement may occur only manually and not accidentally. Further, the nose piece 30 is formed of a high impact plastic which permits the lugs 31, 32, and 33 to flex with respect to one another under the stresses of wind forces applied thereto from the frame members 11.

Figure 4:
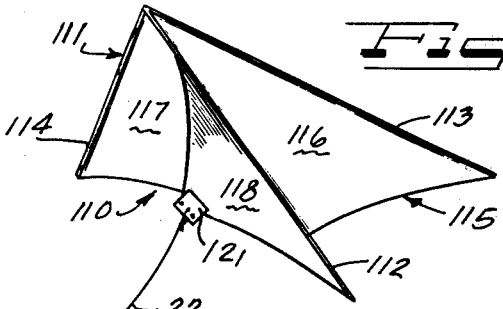
FIG. 4. is a perspective view of a second embodiment of the kite in flight, from below.

A second embodiment of a kite employing the novel string attachment plate and a variation of the nose piece 30 is shown in FIG. 4, at 110. The kite 110 has frame members 112, 113, and 114. These frame members are cylindrical in cross-section, as compared to the only general roundedness or slightly flattened section of the frame members 11 of FIGS. 1–3. A lift surface material 115 is attached loosely by adhesive means between the central frame member 112 and each of the side frame members 113 and 114, to form left and right wing surfaces 116 and 117. A triangular keel 118 is affixed to the lower central part of the lifting surface 115 and the central frame member 112. A string attachment plate 121 is attached to the keel 118 at a lowermost portion thereof to engage a string 22, as before.

Figure 6:
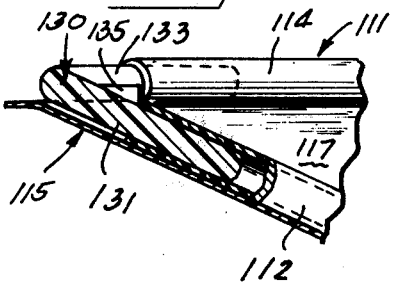
FIG. 6 is a side sectional view on line VI—VI of FIG. 5.
Figure 5:
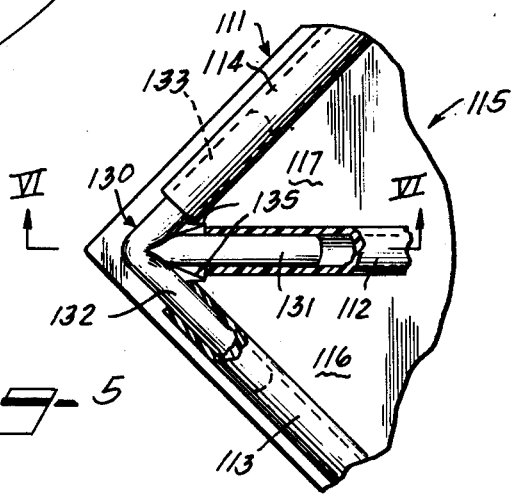
FIG. 5 is a top plan view of a nose piece and frame members of the kite of FIG. 4.

Distinguishing the kite 110 from the kite 10 is the structure for attachment of the frame members 111 together at the nose of the kite. The nose piece 130 is generally similar in function and configuration to the nose piece 30 in top view, as shown in FIGS. 3 and 5, in that the nose piece 130 has a first attachment lug 131 extending along a central plane of the kite and side lugs 132 and 133 extending angularly therefrom. Each of the attachment lugs 131, 132, and 133 is sized to receive snugly thereover the respective frame members 112, 113, and 114. However, as shown in FIG. 6, the attachment lugs 132 and 133 extend in a plane which lies at an angle to the lug 131. Since the lug 131 and central frame member 112 form a principle axis of the kite, the angle between the plane of the lugs 132 and 133 and the lug 131 or frame member 112 provides dihedral to the lift surfaces 116 and 117; that is, the two "wings" of the kite are inclined relative to one another. Such dihedral improves the stability of the kite in both steady and unsteady winds. In the embodiment of the kite of FIGS. 4–6, the flexible sheet material 115 extends forwardly of the nose piece 130, as shown in the Figures.

The nose piece 130 further contains abutment and reinforcing flanges between the adjacent attachment lugs 131 and 133 and 131 and 132, respectively. Such flanges 135 reinforce the joints between the attachment lugs and also prevent the frame members from wedging against one another at the conjunction of the lugs.

Although various minor modifications might be suggested by those versed in the art, it should be understood that I wish to embody within the scope of the patent warranted hereon all such modifications as reasonably and properly come within the scope of my contributions to the art.

I claim as my invention:

1. A keel kite adapted for flying in any of various wind-strength conditions from a string, said kite comprising:

a central, hollow, tubular frame member lying in a longitudinal, central, vertical plane of said kite;

second and third hollow, tubular frame members lying in a plane transferse to said central vertical plane and detachably joined to said central frame member at a nose piece of said kite;

said nose piece comprising integral first, second, and third lugs each removeably receiveable snugly within an end of a respective one of said frame members for orientation thereof in said central and transverse planes, the second and third lugs forming the same angle to the central plane on either side thereof;

a flexible lifting surface attached to and extending among said frame members;

a flexible keel attached to said central frame member in said central plane;

a string attachment plate affixed to a lowermost portion of said keel opposite the central frame members, the plate comprising a reinforcing material and forming at least three apertures therethrough; and the apertures being aligned parallel to the central frame member and spaced apart within a distance of about 2 inches (5 centimeters), whereby said frame members are maintained in their relative planes at said nose piece, and whereby placing said string selectively in a forwardmost one of said apertures decreases the angle of attack of the kite to decrease lift and improve performance in high-speed winds and placing the string in a rearwardmost one of said apertures increases the angle of attack of the kite to increase lift and improve performance in low-speed wind conditions.

2. A kite as defined in claim 1, wherein the lugs of the nose piece are coplanar in said transverse plane.

3. A kite as defined in claim 1, wherein said second and third lugs of said nose piece lie in said transverse plane and said fist lug lies at an angle to said transverse plane.

* * * * *